US010288252B2

(12) United States Patent
Yasuda

(10) Patent No.: US 10,288,252 B2
(45) Date of Patent: May 14, 2019

(54) VEHICLE LAMP UNIT

(71) Applicant: KOITO MANUFACTURING CO., LTD., Tokyo (JP)

(72) Inventor: Yuji Yasuda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 50 days.

(21) Appl. No.: 15/440,317

(22) Filed: Feb. 23, 2017

(65) Prior Publication Data

US 2017/0241617 A1 Aug. 24, 2017

(30) Foreign Application Priority Data

Feb. 23, 2016 (JP) ..... 2016-032406

(51) Int. Cl.
*F21S 41/19* (2018.01)
*F21S 41/39* (2018.01)
(Continued)

(52) U.S. Cl.
CPC ..... *F21S 45/49* (2018.01); *F21S 41/147* (2018.01); *F21S 41/19* (2018.01); *F21S 41/39* (2018.01); *F21S 43/14* (2018.01); *F21S 43/19* (2018.01); *F21S 43/37* (2018.01); *F21S 45/10* (2018.01); *F21S 45/47* (2018.01)

(58) Field of Classification Search
CPC ..... F21S 41/19; F21S 45/49; F21S 41/141; F21S 41/143; F21S 41/147; F21S 43/14; F21S 43/19; F21Y 2115/10; F21V 19/003; F21V 19/0055; B60Q 1/0041
See application file for complete search history.

(56) References Cited

U.S. PATENT DOCUMENTS 7,188,984 B2 * 3/2007 Sayers ..... F21V 5/045 362/545
7,766,524 B2 * 8/2010 Naganawa ..... B60Q 1/085 362/544
(Continued)

FOREIGN PATENT DOCUMENTS

CN 101105286 A 1/2008
CN 101566301 A 10/2009
(Continued)

OTHER PUBLICATIONS

Office Action issued in Chinese Application No. 201710099774.8, dated Dec. 11, 2018 (26 pages).

*Primary Examiner* — Peggy A Neils
(74) *Attorney, Agent, or Firm* — Osha Liang LLP

(57) ABSTRACT

A vehicle lamp unit includes a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element, and a coupling mechanism which couples the plurality of light emitting units. The plurality of light emitting units are arranged such that the circuit substrates are separated from each other and partially overlap with each other in a vehicle width direction. A number of the plurality of light emitting units is three or more.

15 Claims, 6 Drawing Sheets

(51) Int. Cl.

| | |
|---|---|
| ***F21S 43/14*** | (2018.01) |
| ***F21S 43/19*** | (2018.01) |
| ***F21S 43/37*** | (2018.01) |
| ***F21S 45/10*** | (2018.01) |
| ***F21S 45/47*** | (2018.01) |
| ***F21S 45/49*** | (2018.01) |
| ***F21S 41/147*** | (2018.01) |

(56) References Cited

U.S. PATENT DOCUMENTS

| | | | | |
|---|---|---|---|---|
| 7,780,315 | B2 * | 8/2010 | Gasquet | F21K 9/00 362/238 |
| 8,979,314 | B2 * | 3/2015 | Maemura | H01L 33/507 362/259 |
| 9,423,087 | B2 * | 8/2016 | Yamamoto | F21S 41/19 |
| 9,458,976 | B2 * | 10/2016 | Krenn | F21V 14/04 |
| 9,522,628 | B2 * | 12/2016 | Desai | B60Q 1/12 |
| 9,696,002 | B2 * | 7/2017 | Ohashi | F21S 48/23 |
| 2007/0127257 | A1 | 6/2007 | Erion et al. | |
| 2007/0268703 | A1 | 11/2007 | Gasquet et al. | |
| 2009/0262549 | A1 | 10/2009 | Inoue et al. | |
| 2014/0254188 | A1 * | 9/2014 | Masuda | B60Q 1/0023 362/521 |
| 2014/0321149 | A1 | 10/2014 | Ohashi et al. | |
| 2015/0274064 | A1 | 10/2015 | Iyoda et al. | |

FOREIGN PATENT DOCUMENTS

| | | | |
|---|---|---|---|
| CN | 103998856 | A | 8/2014 |
| CN | 104976563 | A | 10/2015 |
| EP | 2792584 | A1 | 10/2014 |
| JP | 2013-168434 | A | 8/2013 |
| JP | 2015-046235 | A | 3/2015 |

* cited by examiner

VEHICLE LAMP UNIT

CROSS-REFERENCE TO RELATED APPLICATIONS

The present application claims the benefit of priority of Japanese Patent Application No. 2016-032406, filed on Feb. 23, 2016, the content of which is incorporated herein by reference.

TECHNICAL FIELD

The present invention relates to a vehicle lamp unit.

BACKGROUND

There has been known a vehicle lamp which is configured by a plurality of Light Emitting Diodes (hereinafter referred to as "LED") and a plurality of reflectors for reflecting light from the LEDs. For example, JP-A-2015-46235 discloses a lamp unit is including a high beam substrate, a low beam substrate, a high beam reflector unit, a low beam reflector unit, a high beam heat radiation plate, and a low beam heat radiation plate.

The lamp unit includes an aluminum plate as a heat radiation member in addition to a circuit substrate on which the LEDs are mounted. Therefore, the number of components tends to increase, and the weight and the size of the overall lamp unit tends to increase.

SUMMARY

An aspect of the present invention provides a novel vehicle lamp unit which satisfies required heat radiation property with a simplified configuration.

According to an embodiment of the present invention, there is provided a vehicle lamp unit comprising: a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in a vehicle width direction, and wherein a number of the plurality of light emitting units is three or more.

According to the above configuration, the plurality of light emitting units are arranged such that the circuit substrates are separated from each other and partially overlap with each other in the vehicle width direction, and therefore, the circuit substrate can be enlarged.

According to another embodiment of the present invention, there is provided a vehicle lamp unit comprising: a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in a vehicle width direction and in a vehicle front-rear direction.

According to the above configuration, the circuit substrates partially overlap with each other in the vehicle width direction and the vehicle front-rear direction, and therefore, the size of the vehicle lamp unit in the vehicle width direction and the vehicle front-rear direction can be reduced.

In the above, each of the circuit substrates of the plurality of light emitting units may be arranged obliquely with respect to a horizontal direction. Thus, the circuit substrate can be enlarged without enlarging the size of the vehicle lamp unit in the vehicle width direction or the vehicle front-rear direction.

In the above, each of the circuit substrates of the plurality of light emitting units may be arranged higher than another circuit substrate adjacent to an inner side thereof in the vehicle width direction. Thus, the plurality of light emitting units can be arranged such that the light emitting units are gradually displaced upward toward an outer side in the vehicle width direction.

In the above, among the circuit substrates of the plurality of light emitting units, the circuit substrate at an outermost side in the vehicle width direction may be larger than the other circuit substrates. Generally, the closer the light emitting unit is to the outer side in the vehicle width direction, the upper the light emitting unit is positioned. Further, air heated by heat of the semiconductor light emitting element flows upward. Therefore, the closer the light emitting unit is to the outer side in the vehicle width direction, the more likely the light emitting unit is to be affected by the heat generated from the light emitting unit at the inner side in the vehicle width direction. Thus, heat radiation performance can be improved by making the circuit substrate at the outermost side in the vehicle width direction larger than the other circuit substrates at the inner side in the vehicle width direction.

According to a further embodiment of the present invention, there is provided a vehicle lamp unit comprising: a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in an upper-lower direction, and wherein a number of the plurality of light emitting units is three or more. Therefore, while a circuit substrate with a size required by heat radiation performance is used, a size of the vehicle lamp unit in the vehicle width direction can be reduced.

In the above, the plurality of light emitting units may include a first light emitting unit and a second light emitting unit adjacent to the first light emitting unit, and the circuit substrate of the first light emitting unit and the circuit substrate of the second light emitting unit may define a gap therebetween though which air passes. Therefore, circuit substrates on both sides of the gap can be cooled by the air passing through the gap.

In the above, a wiring pattern may be formed on a glass epoxy resin surface of the circuit substrate, the semiconductor light emitting element may be mounted on the circuit substrate by using solder, and an output of the semiconductor light emitting element may be 5 W or less. Therefore, the wiring pattern itself can function as a heat radiation member, and the output of the semiconductor light emitting element is 5 W or less, so that even the circuit substrate using solder can be applied to the vehicle lamp unit.

Further, any combination of the above configuration elements and conversions of the expressions of the present invention among the methods, apparatus, and systems are also applicable as the present invention.

According to the above, a novel lamp unit which satisfies heat radiation property with a simplified configuration can be provided.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
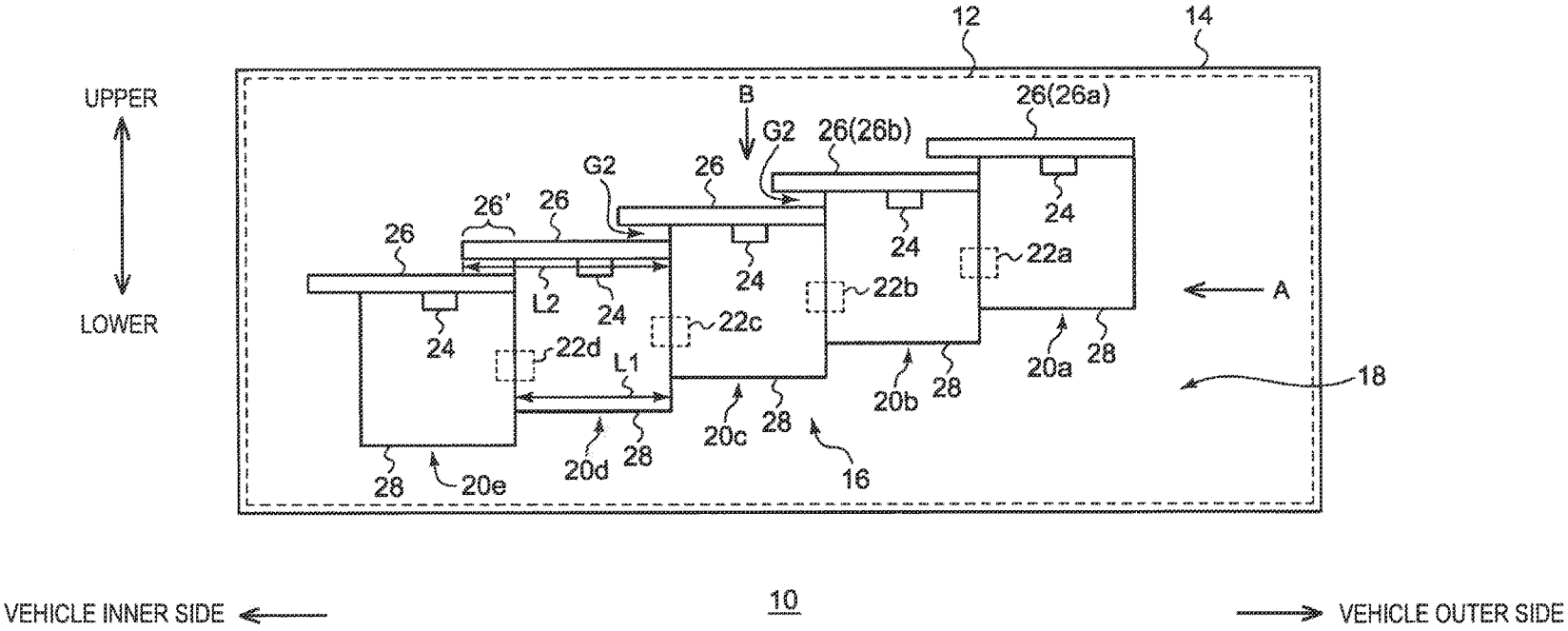
FIG. 1 is a front view schematically illustrating a vehicle lamp according to a first embodiment when viewed from the front.

Hereinafter, embodiments of the present invention are described in details with reference to the drawings. In the explanation of the drawings, same elements are designated with same reference numerals, respectively, and repeated description is properly omitted. Further, the following configurations are merely exemplary, and do not limit the scope of the present invention.

First Embodiment

Figure 2:
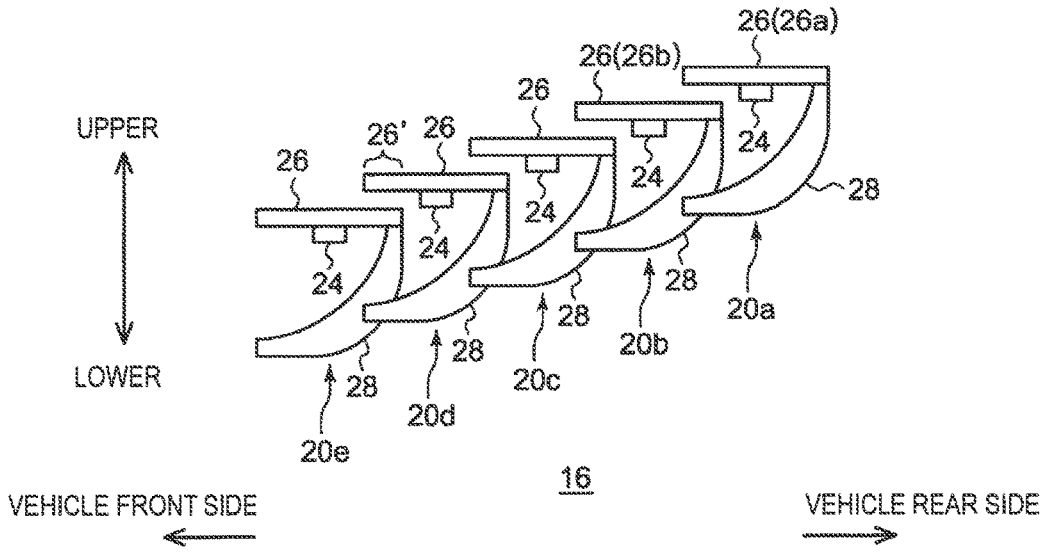
FIG. 2 is a schematic side view of a lamp unit according to the first embodiment when viewed from the direction A of FIG. 1.
Figure 3:
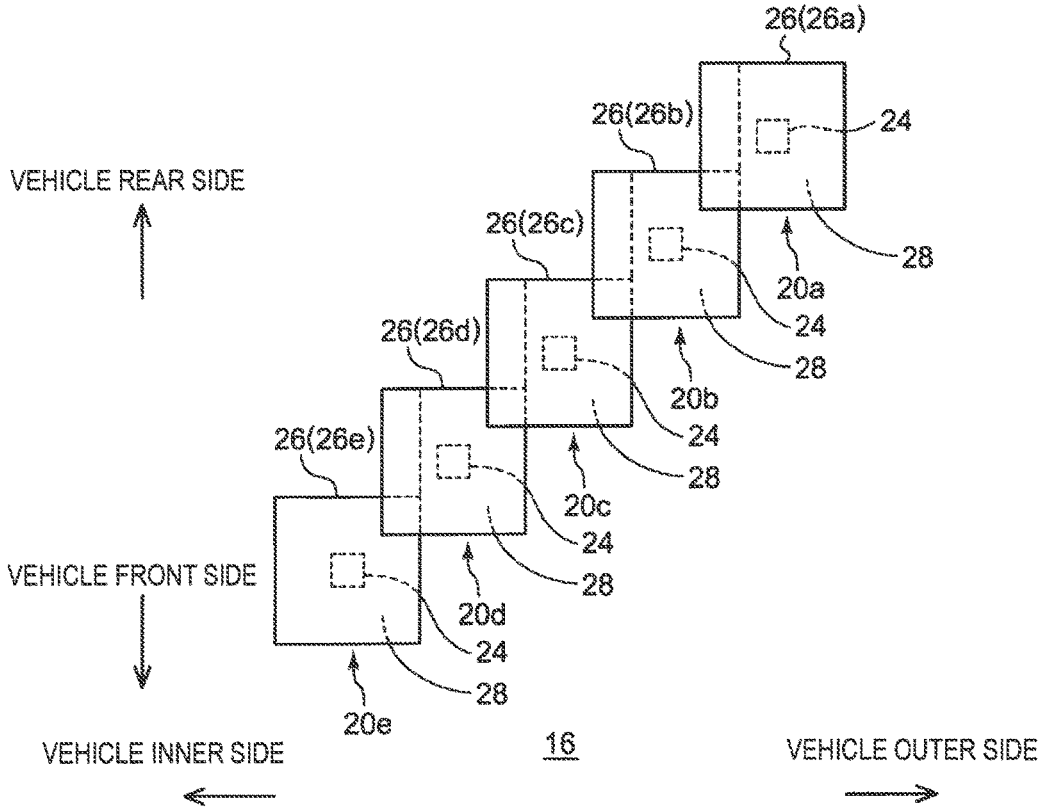
FIG. 3 is a schematic top view of the lamp unit according to the first embodiment when viewed from the direction B of FIG. 1.

FIG. 1 is a front view schematically illustrating a vehicle lamp 10 according to a first embodiment when viewed from the front. FIG. 2 is a schematic side view of a lamp unit 16 according to the first embodiment when viewed from the direction A of FIG. 1. FIG. 3 is a schematic top view of the lamp unit 16 according to the first embodiment when viewed from the direction B of FIG. 1.

The vehicle lamp 10 illustrated in FIG. 1 includes a lamp body 12, an outer cover 14, and the lamp unit 16. The lamp body 12 and the outer cover 14 define a space as a lamp room 18. The outer cover 14 has a shape following a slant nose of a vehicle and tilted toward a vehicle rear side from a vehicle inner side to a vehicle outer side.

The lamp unit 16 includes a plurality of light emitting units 20*a* to 20*e* (hereinafter, referred to as "light emitting unit 20"), and coupling parts 22*a* to 22*d* (hereinafter, collectively referred to as "coupling mechanism 22") for coupling adjacent light emitting units 20. The coupling mechanism 22 may employ various means such as screw fastening, bonding (joining), engaging, welding, and locking.

The light emitting unit 20 has a light emitting element 24, a circuit substrate 26 on which the light emitting element 24 is mounted and having a circuit for supplying power to the light emitting element 24, and a reflector 28 as art optical member which reflects light emitted downward from the light emitting element 24 toward a vehicle front direction. The reflector 28 is fixed to the circuit substrate 26 through screw fastening, thermal crimping, or the like. The reflector 28 may be fastened to the circuit substrate 26 through another member such as a bracket by screws. The light emitting element 24 is preferably a semiconductor light emitting element, for example, a Light Emitting Diode (LED) element, an Organic Light Emitting Diode (OLED) element, a Laser Diode (LD) element, and an Electroluminescence (EL) element.

An output of the light emitting element 24 can be properly selected based on required light distribution performance of the vehicle lamp 10. However, if considering heat radiation performance, the output should be 30 W or less, preferably 10 W or less, and more preferably 5 W or less. Thereby, a heat radiation mechanism such as a heat sink can be omitted or the size thereof can be reduced. Further, even when a heat sink is required, less expensive materials can be used.

The circuit substrate 26 can improve the heat radiation performance by properly changing the arrangement of the respective light emitting units 20 as described in the following, so that inexpensive insulating resin substrates such as glass epoxy resin can be used, instead of expensive materials such as ceramic substrates. In the circuit substrate 26, a wiring pattern is formed on a surface thereof, and an LED element of a Surface Mount Device (SMD) type is mounted by using solder, as the light emitting element 24. Therefore, the wiring pattern itself can function as a heat radiation member. Further, by suppressing the output of the light emitting element 24, even the circuit substrate 26 using solder can be applied to the lamp unit 16. In this case, the light emitting element 24 is fixed to the circuit substrate 26 by using solder and can be supplied with power, so that compared to a case where power supply and fixation between the element and the substrate are carried out by different members, manufacturing processes can be simplified and the number of components can be reduced.

In the lamp unit 16 according to the first embodiment, the light emitting units 20*a* to 20*e* are arranged such that the circuit substrates 26 are separated from each other and partially overlap with each other by a portion 26' in a vehicle width direction (a left-right direction in FIG. 1). Thus, a length L2 of the circuit substrate 26 in the vehicle width direction can be greater than a length L1 of the reflector 28 in the vehicle width direction, so that the heat radiation property can be improved.

Therefore, even if a heat radiation member such as an aluminum plate is not additionally provided, or an aluminum plate with low heat radiation performance is used, the desired heat radiation property can be satisfied. In other words, a width of the lamp unit 16 can be reduced, and the configuration can be simplified while maintaining heat radiation property. In the lamp unit 16 according to the first embodiment, the light emitting units 20 are provided in plural, and preferably three or more. Accordingly, a lamp unit can be configured by coupling the plurality of light emitting units, so that the vehicle lamp 10 can be adapted to a wide variety of vehicles by properly selecting the number of the light emitting units to be coupled even if light distribution properties and vehicle sizes are different.

Further, in the side view illustrated in FIG. 2, in the lamp unit 16 according to the first embodiment, the light emitting units 20 are arranged such that the circuit substrates 26 are separated from each other and partially overlap with each other by a portion 26' in the vehicle front-rear direction. Therefore, the circuit substrates 26 overlap with each other by the portion 26' in the vehicle width direction and in the vehicle front-rear direction, so that the size of the lamp unit 16 in the vehicle width direction and the vehicle front-rear direction can be reduced.

Further, in the lamp unit 16 according to the first embodiment, each circuit substrate 26 (26*a*) of the plurality of light emitting units 20 is arranged higher than another circuit substrates 26 (26*b*) adjacent to an inner side of the circuit substrate 26 (26*a*) in the vehicle width direction. Thus, as illustrated in FIGS. 1 and 2, the plurality of light emitting units 20 can be arranged such that the light emitting units 20 are gradually displaced upward toward an outer side in the vehicle width direction.

Moreover, in the lamp unit 16 as illustrated in FIG. 3, among the circuit substrates 26 of the plurality of light emitting units 20, a circuit substrate 26*a* at an outermost side in the vehicle width direction is preferably larger than the other circuit substrates 26*b* to 26*e*. The air heated by heat of the light emitting element 24 flows upward, so that the closer the light emitting unit (for example, the light emitting unit 20*a*) is to the outer side in the vehicle width direction, the more likely the light emitting unit is to be affected by the heat generated from the light emitting unit (for example, the light emitting units 20*b* to 20*e*) at the inner side in the vehicle width direction. Thus, heat radiation performance can be improved by making the circuit substrate 26*a* at the outermost side in the vehicle width direction larger than the other circuit substrates 26*b* to 26*e* at the inner side in the vehicle width direction.

More specifically, when an area of the circuit substrate 26*a* (for example, an area in the top view in FIG. 3) is set to S1, an area of the circuit substrate 26*b* is set to S2, an area of the circuit substrate 26*c* is set to S3, an area of the circuit substrate 26*d* is set to S4, and an area of the circuit substrate 26*e* is set to S5, the following relationship is preferably satisfied.

$S5 \leq S4 \leq S3 \leq S2 \leq S1$ (wherein, $S5=S4=S3=S2-S1$ is excluded.)

Second Embodiment

Figure 4:
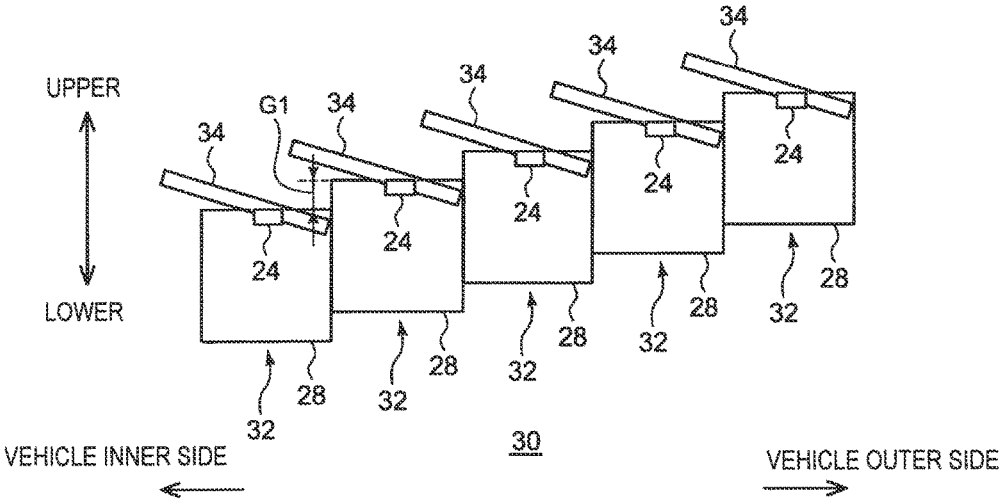
FIG. 4 is a front view schematically illustrating a lamp unit according to a second embodiment.

FIG. 4 is a front view schematically illustrating a lamp unit according to a second embodiment. Herein, for a configuration similar to that of the lamp unit 16 according to the first embodiment, the same reference numerals are designated and description thereof is properly omitted.

In a lamp unit 30 according to the second embodiment, five light emitting units 32 are coupled along the vehicle width direction. A circuit substrate 34 of each light emitting unit 32 is obliquely arranged with respect to a horizontal direction (the vehicle width direction). The circuit substrate 34 extends upward from the vehicle outer side to the vehicle inner side. Therefore, the circuit substrate 34 can be enlarged without enlarging the size of the lamp unit 30 in the vehicle width direction or the vehicle front-rear direction. In addition, even if a displacement G1 between two adjacent light emitting units 32 in the upper-lower direction is small, interference between the two adjacent circuit substrates 34 can be avoided.

Figure 5:
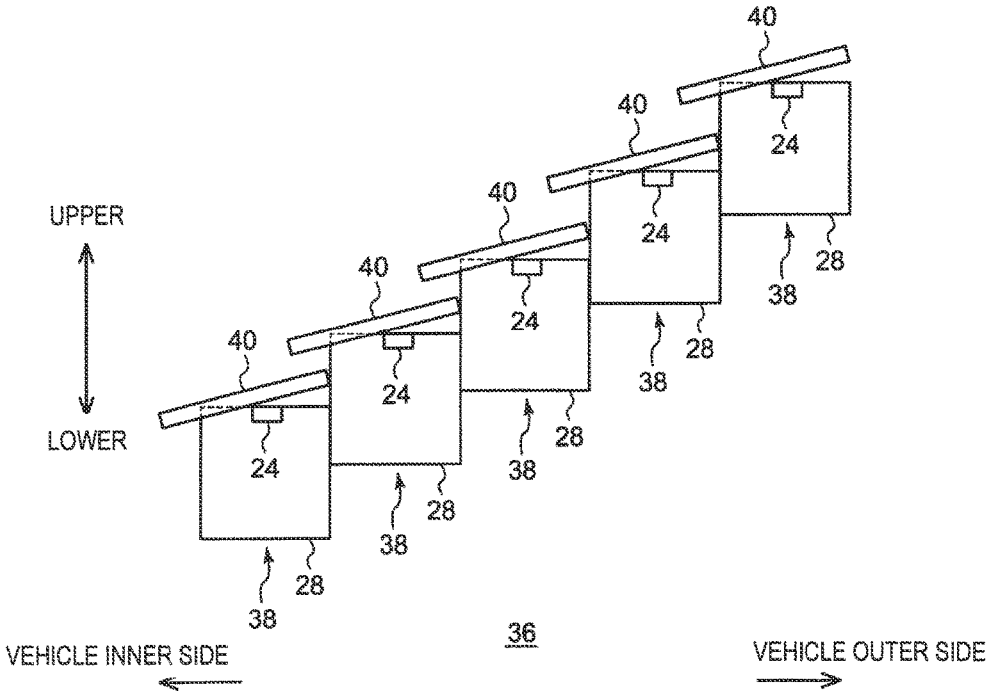
FIG. 5 is a front view schematically illustrating a lamp unit according to a modification of the second embodiment.

FIG. 5 is a front view schematically illustrating a lamp unit according to a modification of the second embodiment. A tilting direction of a circuit substrate 40 in a light emitting unit 38 of a lamp unit 36 is different from that of the circuit substrate 34 in the light emitting unit 32. In particular, the circuit substrate 40 extends downward from the vehicle outer side to the vehicle inner side. Therefore, the circuit substrate 40 can be enlarged without enlarging the size of the lamp unit 36 in the vehicle width direction or the vehicle front-rear direction. In addition, the orientation of each circuit substrate 40 is arranged linearly from the vehicle inner side to the vehicle outer side, so that upward flow of heat generated from each light emitting unit 38 is less obstructed.

Third Embodiment

Figure 6:
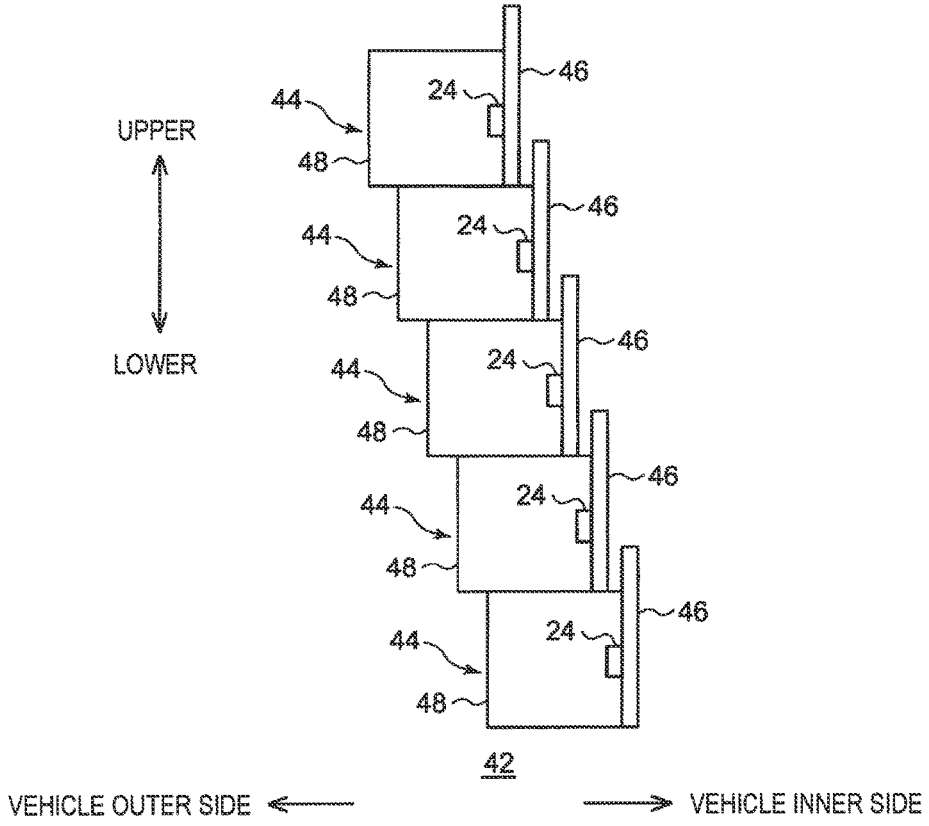
FIG. 6 is a front view schematically illustrating a lamp unit according to a third embodiment.

FIG. 6 is a front view schematically illustrating of a lamp unit according to a third embodiment. Herein, for a configuration similar to that of the lamp unit 16 according to the first embodiment, the same reference numerals are designated and description is properly omitted.

In a lamp unit 42 according to the third embodiment, five light emitting units 44 are coupled along the upper-lower direction. A circuit substrate 46 of each light emitting unit 44 is arranged along the vehicle upper-lower direction, the light emitting element 24 of each light emitting unit 44 is mounted on a circuit substrate 46 such that a light emitting surface 24*a* faces toward an outer side in the vehicle width direction, and a reflector 48 of each light emitting unit 44 is configured to reflect light emitted from the light emitting element 24 toward a vehicle front direction. The plurality of light emitting units 44 are arranged such that the circuit substrates 46 are separated from each other and overlap with each other by a portion in the upper-lower direction. Thus, while the circuit substrate 46 with a size required for heat radiation property is used, the size of the lamp unit 42 in the vehicle width direction can be reduced.

Fourth Embodiment

Figure 7:
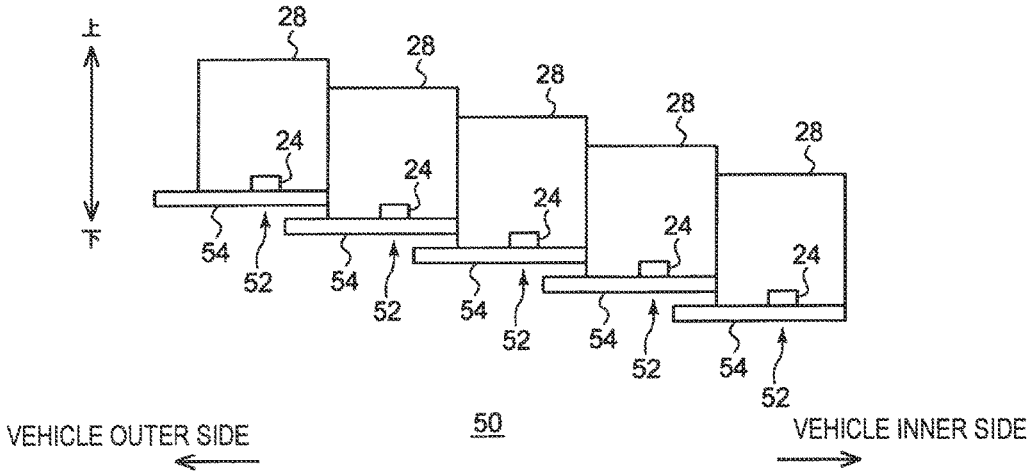
FIG. 7 is a front view schematically illustrating a lamp unit according to a fourth embodiment.

FIG. 7 is a front view schematically illustrating a lamp unit according to the fourth embodiment. Herein, for a configuration similar to that of the lamp unit 16 according to the first embodiment, the same reference numerals are designated and description thereof is properly omitted.

In a lamp unit 42 according to the fourth embodiment, five light emitting units 52 are coupled along the vehicle width direction. A circuit substrate 54 of each light emitting unit 52 is arranged in a lower portion of the light emitting unit 52. A reflector 28 is arranged in an upper portion of the circuit substrate 54 and reflects light emitted upward from the light emitting element 24 toward the vehicle front direction.

Fifth Embodiment

Figure 8:
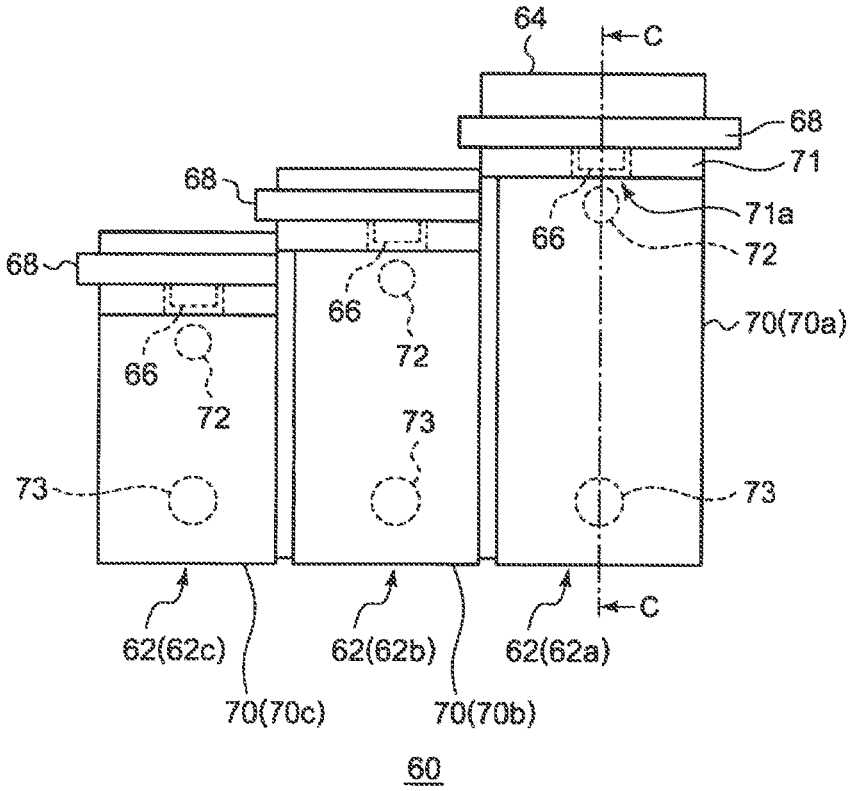
FIG. 8 is a front view schematically illustrating a vehicle lamp according to a fifth embodiment when viewed from the front.
Figure 9:
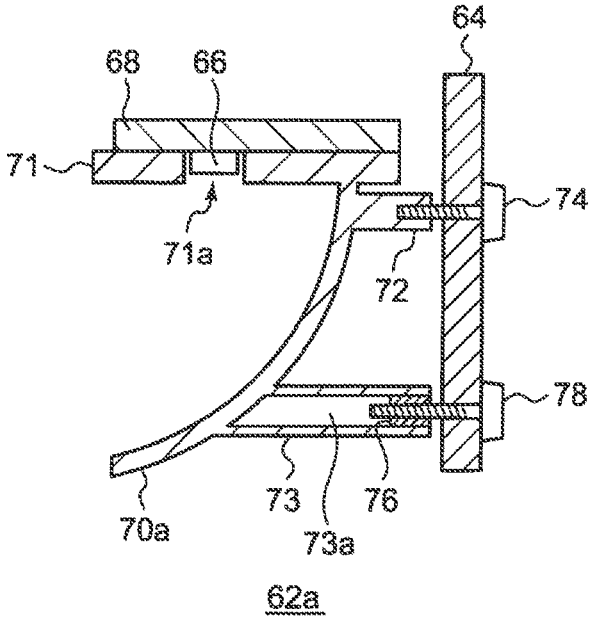
FIG. 9 is a sectional view of a lamp unit of FIG. 8 taken along a line C-C.
Figure 10:
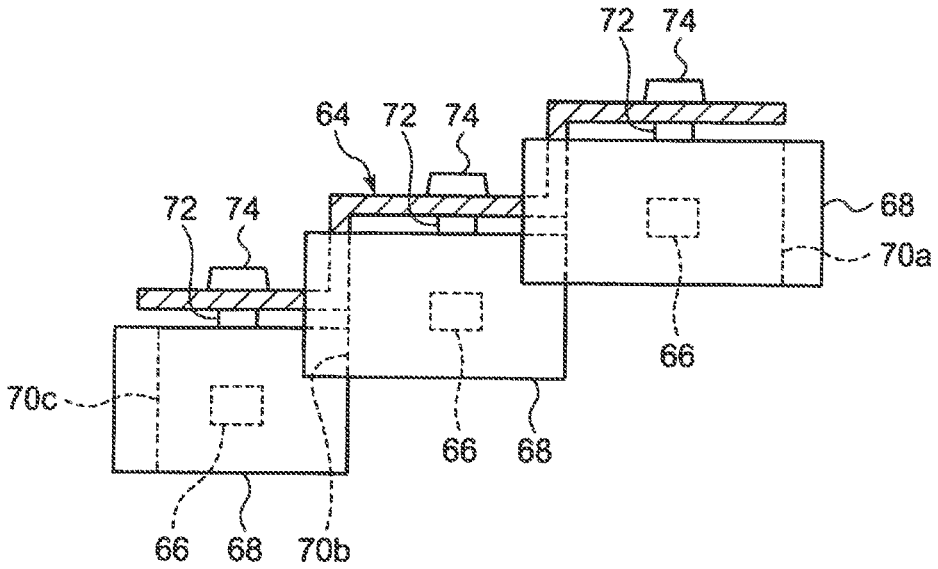
FIG. 10 is a top view of the lamp unit of FIG. 8.

FIG. 8 is a front view illustrating a vehicle lamp according to a fifth embodiment when viewed from the front. FIG. 9 is a sectional view of a lamp unit of FIG. 8 taken along a line C-C. FIG. 10 is a top view of the lamp unit of FIG. 8.

The lamp unit 60 illustrated in FIG. 8 includes three light emitting units 62*a* to 62*c* (hereinafter, referred to as "light emitting unit 62") and a bracket 64 for coupling adjacent light emitting units with each other.

Each light emitting unit 62 (62*a* to 62*c*) has a light emitting element 66 such as an LED, a circuit substrate 68 on which the light emitting unit 66 is mounted and which supplies power to the light emitting unit 66, and a reflector 70 (70*a* to 70*c*) for reflecting light emitted downward from the light emitting element 66 toward the vehicle front direction. At the back side of the reflector 70, two bosses 72, 73 are disposed at positions separated in the upper-lower direction.

As illustrated in FIG. 9, the light emitting unit 62*a* close to a side on the vehicle outer side is configured such that an opening part 71*a* is formed on a top surface 71 of the reflector 70, and the light emitting element 66 is arranged in the opening part 71*a*. A lower surface of the light emitting element 66 is a light emitting surface, mainly the light emitting element 66 emits light downward.

A screw 74 extending through the bracket 64 is fastened on a boss 72, so that the bracket 64 and the reflector 70*a* are fixed to each other. A hole 73*a* is formed on a boss 73. A self-locking nut 76 is inserted and fixed in the hole 73*a*. An adjusting screw 78 extending through the bracket 64 is fastened on the self-locking nut 74 provided in the boss 73, so that the bracket 64 and the reflector 70*a* are fixed to each other.

As mentioned above, in the lamp unit 40, the three light emitting units 62 are coupled along the vehicle width direction through the bracket 64. By adjusting the adjusting screw 78, an optical axis of each light emitting unit 62 can be adjusted along the upper-lower direction.

In the above embodiments, a gap (for example, an area illustrated by reference numeral G2 in FIG. 1), through which air passes, may be formed between the circuit substrate of the light emitting unit and the circuit substrate of the adjacent light emitting unit. Therefore, the circuit substrates on both sides of the gap can be cooled by the air passing through the gap.

The present invention is illustrated with reference to the above embodiments, but is not limited thereto. Appropriate combination and substitution of above embodiments are also within the inventive concept of the present invention. Further, based on knowledge of those skilled in the art, the combinations and processing order in each embodiment can be replaced appropriately, and modifications such as various design variations made to the embodiments are also within the inventive concept of the present invention.

In the above embodiments, there has been described the light emitting unit using a reflector as an optical member. However, the light emitting unit may use a projection lens which refracts light emitted from the light emitting element as an optical member. In this case, the light emitting element may be configured such that the light emitting surface faces the incidence surface of the projection lens, and may be configured such that the circuit substrate on which the light emitting element is mounted faces toward the vehicle front direction.

What is claimed is:

1. A vehicle lamp unit comprising:

a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in a vehicle width direction, wherein a number of the plurality of light emitting units is three or more, and wherein each of the circuit substrates of the plurality of light emitting units is arranged higher than another circuit substrate adjacent to an inner side thereof in the vehicle width direction.

2. The vehicle lamp unit according to claim 1, wherein each of the circuit substrates of the plurality of light emitting units is arranged obliquely with respect to a horizontal direction.

3. The vehicle lamp unit according to claim 1, wherein among the circuit substrates of the plurality of light emitting units, the circuit substrate at an outermost side in the vehicle width direction is larger than the other circuit substrates.

4. The vehicle lamp unit according to claim 1, wherein the plurality of light emitting units includes a first light emitting unit and a second light emitting unit adjacent to the first light emitting unit, and wherein the circuit substrate of the first light emitting unit and the circuit substrate of the second light emitting unit define a gap therebetween though which air passes.

5. The vehicle lamp unit according to claim 1, wherein a wiring pattern is formed on a glass epoxy resin surface of the circuit substrate, and the semiconductor light emitting element is mounted on the circuit substrate by using solder, and wherein an output of the semiconductor light emitting element is 5 W or less.

6. A vehicle lamp unit comprising:

a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in a vehicle width direction and in a vehicle front-rear direction.

7. The vehicle lamp unit according to claim 6, wherein each of the circuit substrates of the plurality of light emitting units is arranged obliquely with respect to a horizontal direction.

8. The vehicle lamp unit according to claim 6, wherein each of the circuit substrates of the plurality of light emitting units is arranged higher than another circuit substrate adjacent to an inner side thereof in the vehicle width direction.

9. The vehicle lamp unit according to claim 8, wherein among the circuit substrates of the plurality of light emitting units, the circuit substrate at an outermost side in the vehicle width direction is larger than the other circuit substrates.

10. The vehicle lamp unit according to claim 6, wherein the plurality of light emitting units includes a first light emitting unit and a second light emitting unit adjacent to the first light emitting unit, and wherein the circuit substrate of the first light emitting unit and the circuit substrate of the second light emitting unit define a gap therebetween though which air passes.

11. The vehicle lamp unit according to claim 6, wherein a wiring pattern is formed on a glass epoxy resin surface of the circuit substrate, and the semiconductor light emitting element is mounted on the circuit substrate by using solder, and wherein an output of the semiconductor light emitting element is 5 W or less.

12. A vehicle lamp unit comprising:

a plurality of light emitting units, each light emitting unit including a semiconductor light emitting element, a circuit substrate on which the semiconductor light emitting element is mounted and having a circuit for supplying power to the semiconductor light emitting element, and an optical member for reflecting or refracting light emitted from the semiconductor light emitting element; and a coupling mechanism which couples the plurality of light emitting units, wherein the plurality of light emitting units are arranged such that the circuit substrates are separated from each other and partially overlap with each other in an upper-lower direction, and wherein a number of the plurality of light emitting units is three or more.

13. The vehicle lamp unit according to claim 12, wherein the plurality of light emitting units includes a first light emitting unit and a second light emitting unit adjacent to the first light emitting unit, and wherein the circuit substrate of the first light emitting unit and the circuit substrate of the second light emitting unit define a gap therebetween though which air passes.

14. The vehicle lamp unit according to claim 12, wherein a wiring pattern is formed on a glass epoxy resin surface of the circuit substrate, and the semiconductor light emitting element is mounted on the circuit substrate by using solder, and wherein an output of the semiconductor light emitting element is 5 W or less.

15. The vehicle lamp unit according to claim 1, wherein the circuit substrates comprise a first circuit substrate, a second circuit substrate adjacent to the first circuit substrate, and a third circuit substrate adjacent to the second circuit substrate, wherein the first circuit substrate partially overlaps with the second circuit substrate in the vehicle width direction, wherein the second circuit substrate partially overlaps with the third circuit substrate in the vehicle width direction, wherein the first circuit substrate is separated from and does not overlap the third circuit substrate in the vehicle width direction.

* * * * *